US006461084B1

(12) United States Patent
Stuart

(10) Patent No.: US 6,461,084 B1
(45) Date of Patent: Oct. 8, 2002

(54) POST ANCHOR

(75) Inventor: Ian Matear Stuart, MS 1497 Wellcamp, Toowoomba, Queensland, 4350 (AU)

(73) Assignee: Ian Matear Stuart, Buderim (AU)

( * ) Notice: Subject to any disclaimer, the term of this patent is extended or adjusted under 35 U.S.C. 154(b) by 0 days.

(21) Appl. No.: 09/325,537

(22) Filed: Jun. 4, 1999

(30) Foreign Application Priority Data

Dec. 23, 1998 (AU) ..... PP7870

(51) Int. Cl.[7] ..... E02D 5/80

(52) U.S. Cl. ..... 405/244; 248/156; 248/530; 52/155; 52/298; 52/165

(58) Field of Search ..... 405/244, 259.1, 405/232, 231; 248/87, 156, 159, 523, 530, 545; 52/155, 153, 165, 169.13, 169.9, 298, 40; 138/120; 223/89, 90

(56) References Cited

U.S. PATENT DOCUMENTS

| | | | | |
|---|---|---|---|---|
| 239,080 A | * | 3/1881 | Baker | 52/298 |
| 519,445 A | * | 5/1894 | Cooper | 52/298 |
| 1,038,198 | * | 9/1912 | Randall et al. | 248/159 |
| 1,155,589 | * | 10/1915 | McDonald | 248/530 |
| 1,399,426 | * | 12/1921 | Harding | 52/165 |
| 1,982,569 | * | 11/1934 | Byrd | 52/298 |
| 2,349,110 | * | 5/1944 | Potstada | 52/165 |
| 2,874,547 | * | 2/1959 | Fiore et al. | 52/165 |
| 2,889,614 | * | 6/1959 | Seely | 52/155 |
| 3,011,598 | * | 12/1961 | Galloway et al. | 52/298 |
| 3,066,447 | * | 12/1962 | Reiterer et al. | 52/155 |
| 3,216,306 | * | 11/1965 | Taylor | 405/259.1 |
| 3,417,525 | * | 12/1968 | Dashio | 52/298 |
| 3,519,234 | * | 7/1970 | Matson | 248/156 |
| 3,638,863 | * | 2/1972 | Roberts | 248/87 |
| 4,185,424 | * | 1/1980 | Streit | 52/155 |

(List continued on next page.)

FOREIGN PATENT DOCUMENTS

| | | | | |
|---|---|---|---|---|
| AU | A-52067-98 | | 4/1998 | |
| AU | B-60779-98 | | 7/1998 | |
| AU | 136541 | | 8/1998 | |
| AU | 136542 | | 8/1998 | |
| AU | 136543 | | 8/1998 | |
| FR | 2560268 | * | 2/1984 | E04H/17/22 |

*Primary Examiner*—Thomas B. Will
*Assistant Examiner*—Alexandra Pechhold
(74) *Attorney, Agent, or Firm*—Hunton & Williams

(57) ABSTRACT

A post anchor comprising a ground engaging portion in the form of fins and a post receiving portion in the form of deflectable collets that are clamped against a post by a clamping member. A damaged post can be easily replaced by removing the clamping member, replacing the post and reapplying the clamping member.

14 Claims, 6 Drawing Sheets

U.S. PATENT DOCUMENTS

| | | | | |
|---|---|---|---|---|
| 4,249,715 | * | 2/1981 | Repp | 248/545 |
| 4,269,010 | * | 5/1981 | Glass | 52/298 |
| 4,523,880 | * | 6/1985 | Isler | 405/259.1 |
| 4,588,157 | * | 5/1986 | Mills | 248/545 |
| 4,589,500 | * | 5/1986 | Moraly | 405/232 |
| 4,649,678 | * | 3/1987 | Lamson | 52/165 |
| 4,874,149 | * | 10/1989 | Miceli | 248/530 |
| 5,017,047 | * | 5/1991 | Myles et al. | 405/259.1 |
| 5,046,693 | * | 9/1991 | Browne | 248/159 |
| 5,082,231 | * | 1/1992 | Knowles | 248/545 |
| 5,090,165 | * | 2/1992 | Kenny | 52/165 |
| 5,203,817 | * | 4/1993 | Klumpjan | 52/298 |
| 5,337,989 | * | 8/1994 | Apple | 248/523 |
| 5,363,607 | * | 11/1994 | Turturro | 52/40 |
| 5,482,245 | * | 1/1996 | Graves | 248/523 |
| 5,485,700 | * | 1/1996 | Van Vranken | 52/298 |
| 5,524,855 | * | 6/1996 | Lesar | 248/530 |
| 5,571,229 | * | 11/1996 | Fitzsimmons et al. | 52/298 |
| 5,632,464 | * | 5/1997 | Aberle | 248/530 |
| 5,709,366 | * | 1/1998 | Speece | 248/530 |
| 5,752,349 | * | 5/1998 | Fitzsimmons et al. | 52/165 |
| 5,803,426 | * | 9/1998 | Hart | 248/523 |
| 6,006,399 | * | 12/1999 | Massaro | 138/120 |
| 6,033,153 | * | 3/2000 | Fergusson | 405/259.1 |
| 6,039,298 | * | 3/2000 | Stier | 248/545 |
| 6,041,559 | * | 3/2000 | Schickert et al. | 52/165 |
| 6,098,361 | * | 8/2000 | Roten et al. | 52/298 |

* cited by examiner

POST ANCHOR

This invention relates to an improved post anchor and in particular to a post anchor having an improved method of securing a post to the anchor.

BACKGROUND TO THE INVENTION

Posts, such as sign posts, fence posts etc, are typically held in the ground by digging a hole, placing the post in the hole and filling the hole with concrete or firmly compacted soil. This process is effective but time consuming. Furthermore, any impact to the post results in damage which can only be corrected by complete removal of the post and repositioning of a new post following the same procedure.

The above procedure has proven to be particularly unsuitable for posts carrying road signs or other similar situations. This unsuitability is due to the high incidence of damage which can occur with road signs. For example, a Keep Left sign will be subject to a high probability of damage due to a vehicle failing to adequately respond to the keep left direction. In the case of a vehicle impacting a sign, the sign must be completely removed and replaced. As mentioned above, this is a time consuming and therefore expensive process.

The problem has been addressed in the prior art by providing post anchors which are decoupled from the post. In the prior art, a number of examples exist of a post anchor which is independently driven into the ground at a location in which a post is to be positioned. The post is then associated with the post anchor by some form of clamping means. Typically, the post anchor is a finned assembly made from pressed mild steel.

In the simplest form, the post is welded to the top of the post anchor once the post anchor has been driven into the ground. Other arrangements have been developed in which a cup is provided at the top of the post anchor into which the post is seated. Fixing arrangements between the cup and the post include bolts and rivets for metal poles or nails for wooden poles. It is also known to provide spikes on the inside wall of the cup to capture wooden poles that are driven into the cup.

Other arrangements include clamping systems to associate the post with the cup. In this solution the post is inserted into the cup and a wedge is driven between the post and the cup to firmly associate the post with the post anchor. An example of this form of association can be found in Australian Patent Application number 52067/98 in the name of Impact Post Anchors Pty Ltd.

The prior art methods of associating a post with a post anchor have proven to be of limited effectiveness. In particular, the wedging arrangement described in the above mentioned publication has elements extending beyond the confines of the post anchor or the post. These elements can be dangerous to persons and property moving in the vicinity of the post and post anchor. Furthermore, the fastening arrangement is aesthetically unpleasing.

A more suitable manner of securing a post to a post anchor is desirable.

OBJECT OF THE INVENTION

It is an object of the present invention to provide a means for associating a post with a post anchor.

Further objects of the invention will be evident from the following description.

DISCLOSURE OF THE INVENTION

In one form, although it need not be the only or indeed the broadest form, the invention resides in an improved post anchor comprising:

a ground engaging portion comprising two or more fin members;

a post receiving portion comprising two or more collets located between upper portions of said two or more fin members, said collets defining a space dimensioned to receive a post to be associated with said post anchor; and a clamping member adapted to locate around said collets and urge said collets towards engagement with said post when said post is seated in the space.

The ground engaging portion is suitably a stake formed from pressed metal fins that are welded together.

In preference the collets define a cylindrical space and the clamping member is a cup shaped member that sits over the collets. This arrangement suits common cylindrical posts.

Alternatively, the collets may define a rectangular space and the post may have a rectangular cross section adapted to seat in the space defined by the collets.

Suitably the ground engaging portion comprises four fin members and there are four corresponding collets located between upper portions of the fin members.

In the case of collets defining a rectangular space the collets may each define a side of the rectangular space or alternatively may define a corner of the rectangular space.

In one form, the clamping member is forced to locate around the collets by applied force, such as hammering. In an alternate form the clamping member may be screwed on to the collets.

The clamping member may be suitably tapered so to apply increasing pressure to the collets as it is forced into location.

In preference, a ridge is formed towards the top of each collet so that the collet is urged into the space as the clamping member is located around the collets.

BRIEF DETAILS OF THE DRAWINGS

To assist in understanding the invention the preferred embodiments will now be described with reference to the following figures in which.

DETAILED DESCRIPTION OF THE DRAWINGS

Figure 1:
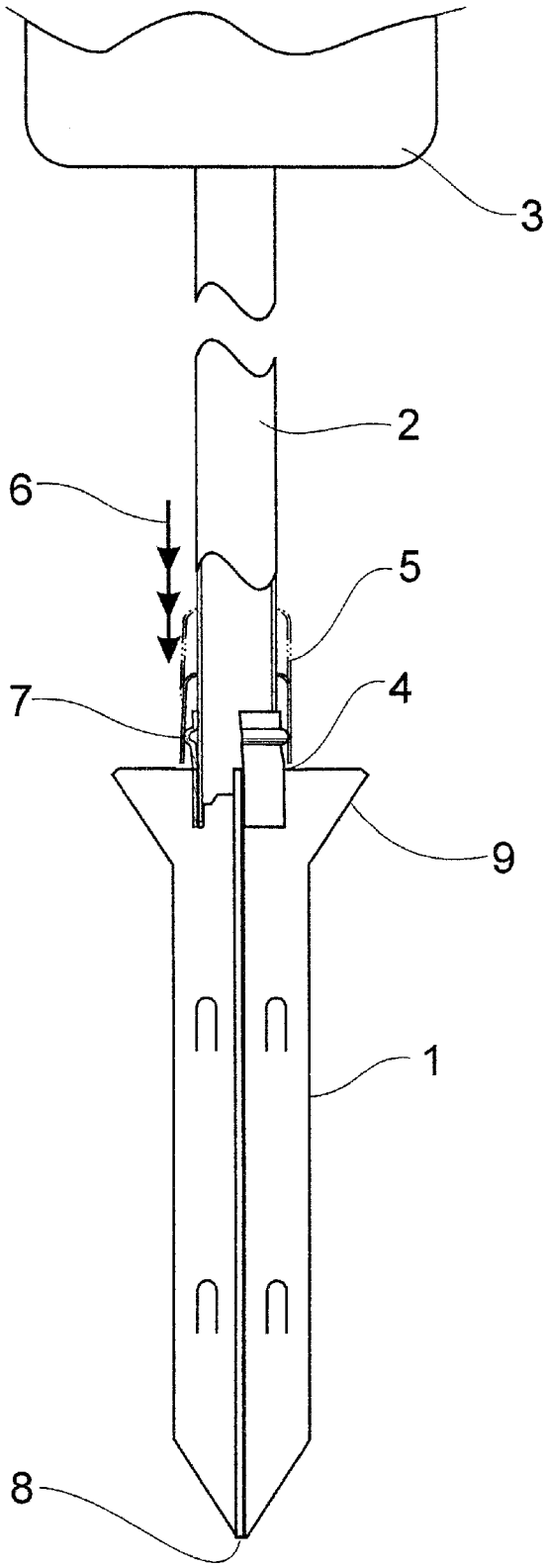
FIG. 1 is a side view of a sign being associated with an improved post anchor.

In the drawing, like reference numerals refer to like parts. Referring to FIG. 1 there is shown an improved post anchor comprising a ground engaging portion 1 and a post 2 associated with the ground engaging portion 1. The post 2 carries a sign 3 which may suitably be a road sign, information sign or other indicia. The post 2 may also be a fence post or other similar upstanding member.

The post 2 seats in a space defined by collets 4. A clamping member 5 is forced onto the collets 4 in the manner shown by arrows 6. The clamping member 5 engages ridge 7 of each collet 4 thereby urging the collet 4 into engagement with post 2.

Figure 2:
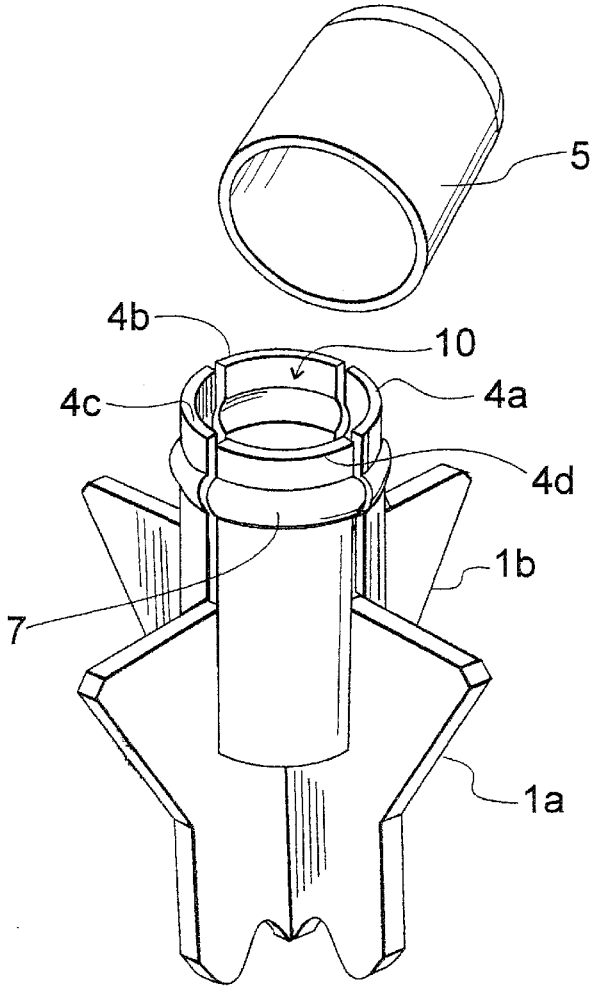
FIG. 2 is an exploded view of the improved post anchor showing the attachment means.

The ground engaging portion 1 comprises two fins 1*a,* 1*b*(seen most clearly in FIG. 2). The fins 1*a,* 1*b* taper at a lower part to form point 8 which aids insertion of the ground engaging portion 1 into the ground. Upper part 9 of the ground engaging portion 1 is of a larger diameter to assist with holding the ground engaging portion firmly in the ground and to provide a firm platform for post 2.

Although a finned structure is preferred, it will be appreciated that a solid structure, on indeed a variety of other structures, will be suitable.

Referring now to FIG. 2, it can be seen that a number of collets 4 are located at the top of the ground engaging portion 1. In the embodiment shown in FIG. 2 there are four collets 4*a,* 4*b,* 4*c,* 4*d.* The collets are each welded to the fins 1*a,* 1*b* so as to define a space 10. The post 2 fits within the space 10.

The clamping member 5 has a diameter slightly larger than the diameter formed by the collets 4 but less than the diameter formed by the ridges 7. Thus, when the clamping member 5 is forced onto the collets 4, it impacts the ridge 7 thereby urging the collets 4 into engagement with the post 2.

In an alternate arrangement (FIG. 9) the ridge 7 can be omitted and the clamping member 5 is provided with a tapering internal dimension. Forcing of the clamping member 5 onto the collets 4 will urge the collets into engagement with the post 2 due to the tapering of the clamping member 5.

Figure 3:
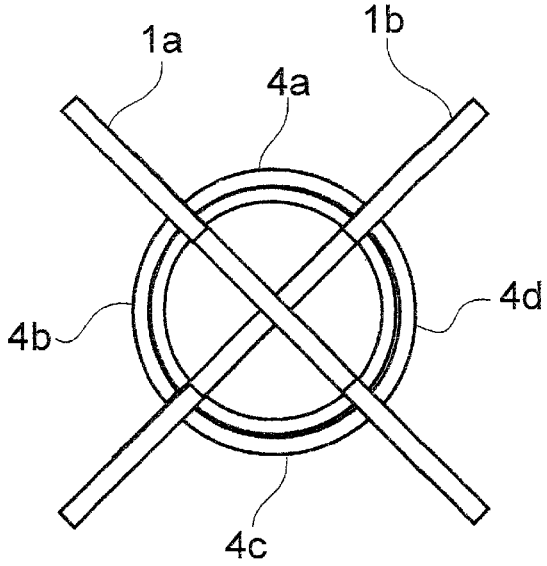
FIG. 3 is a top view of the improved post anchor of FIG. 2.

The arrangement of collets 4*a*–4*d* with relation to the fins 1*a,* 1*b* is shown most clearly in FIG. 3.

Figure 6:
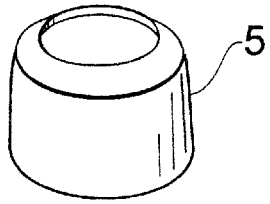
FIG. 6 is a view of a clamping member.
Figure 5:
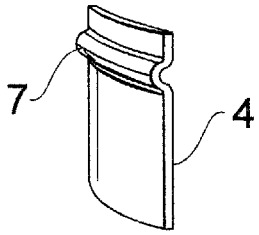
FIG. 5 is a view of a collet.
Figure 4:
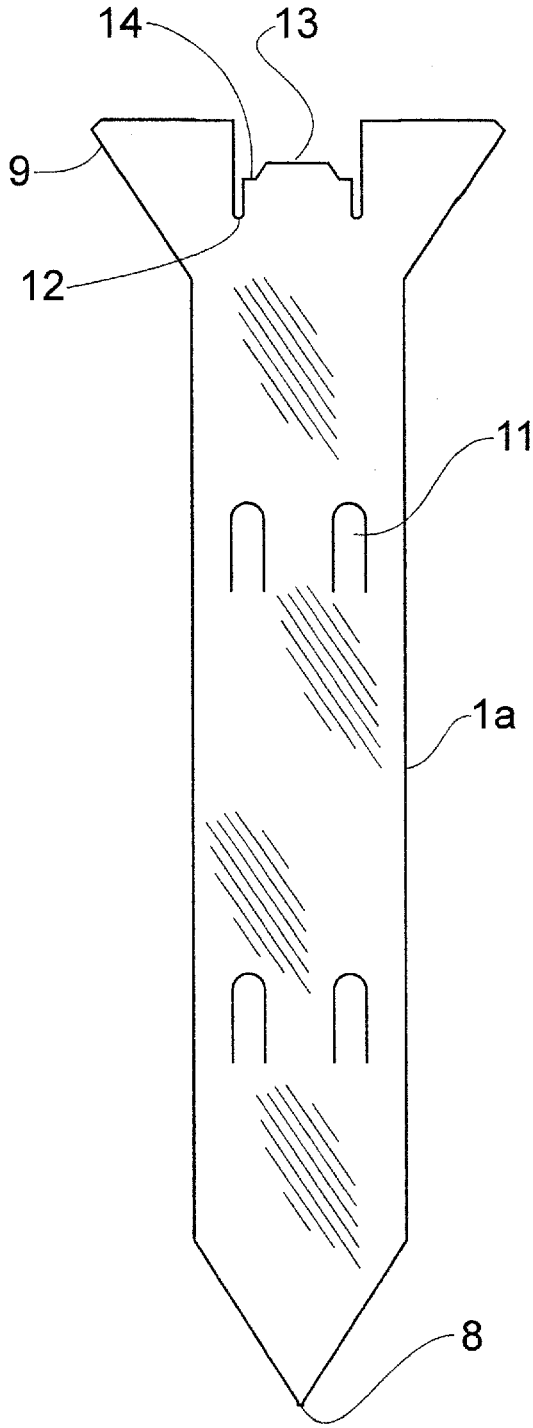
FIG. 4 is a side view of a fin.

Each of the elements of the improved ground anchor are shown in FIGS. 4, 5, and 6. In FIG. 4 there is shown a fin 1*a* which is conveniently laser cut from a single sheet of metal or punched from a coil of metal. The fin la has a number of deflectable portions, such as 11 which may be pushed from the fin 1*a* so as to enhance the engagement of the fin with the ground. The top of fin 1*a* is shaped to receive the post 2. There is a slot 12, sized and shaped to receive a bottom portion of a hollow post. The slot may have parallel sides as shown or may taper to account for different sized posts.

A central portion 13 having a ledge 14 is used for driving the anchor into the ground. A punch (not shown) seats on the ledge. A sledge hammer can then be used against the punch to drive the anchor into the ground without damaging the fins or collets.

The structure of collett 4 is show most clearly in FIG. 5. Each collett is pressed from a piece of sheet metal and has a ridge 7 formed in the upper portion. The collett is of a size and shape to fit between adjacent fins 1*a* & 1*b*. The collett 4 is welded in position such that the ridge 7 is in a position to be engaged by the clamping member 5.

Adjacent collets are positioned so that ridges 7 are aligned. This ensures that the collets 4 are clamped evenly against the post 2 when the clamping member 5 is in position. It will be appreciated that alignment of the ridges is not essential for operation of the invention.

Clamping member 5 is shown most clearly in FIG. 6. The clamping member is substantially cylindrical in shape with a slight taper so as to progressively clamp firmer as it is driven onto the collets. An upper portion of the clamping member is rounded so as to close to a diameter slightly larger than the diameter of the pipe 2.

Clamping of the clamping member onto the collets results in an aesthetically pleasing post anchor apparatus as the only visible portion is the post and sign with the clamping member visible at the base of the post. As the clamping member is only slightly larger in diameter than the post the overall appearance is one of sleekness and smoothness.

As described above, the clamping member 5 is forced onto the collets 4. This is achieved by applying pressure, such as by hammering. If the post must be replaced, for example due to damage, the clamping member must be pulled from the collets, a new post is positioned and the clamping member is reapplied.

Figure 7:
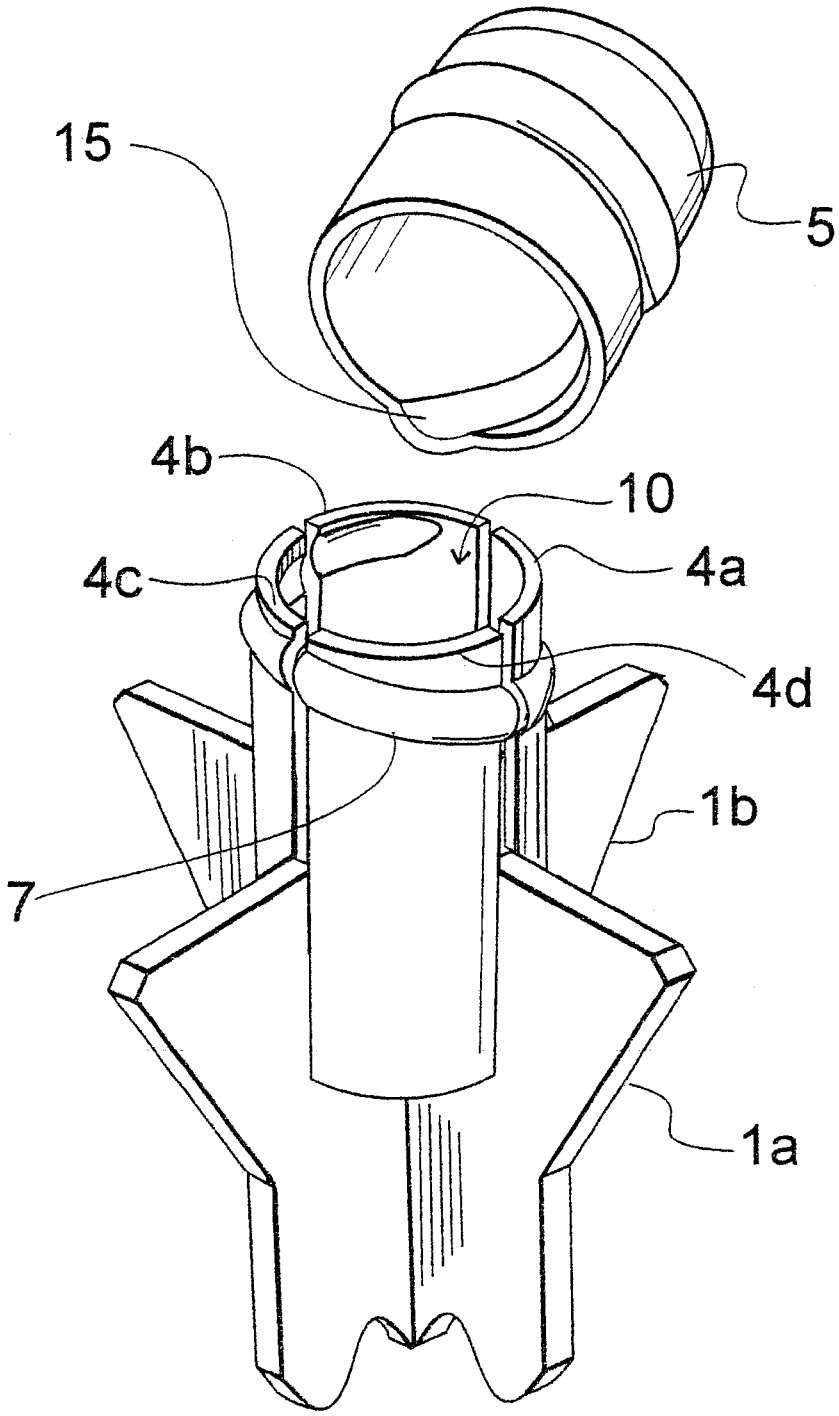
FIG. 7 is an exploded view of a second embodiment of an improved post anchor.

In an alternative arrangement shown in FIG. 7, the inside surface of the clamping member 5 has a coarse thread 15 which allows the clamping member 5 to be screwed onto the ridges 7 of the collets 4. This arrangement facilitates easier application and removal of the clamping member. The clamping member may even take the form of a hose-clamp type collar that can be tightened on to the collets. The hose-clamp arrangement is not preferred.

Figure 8:
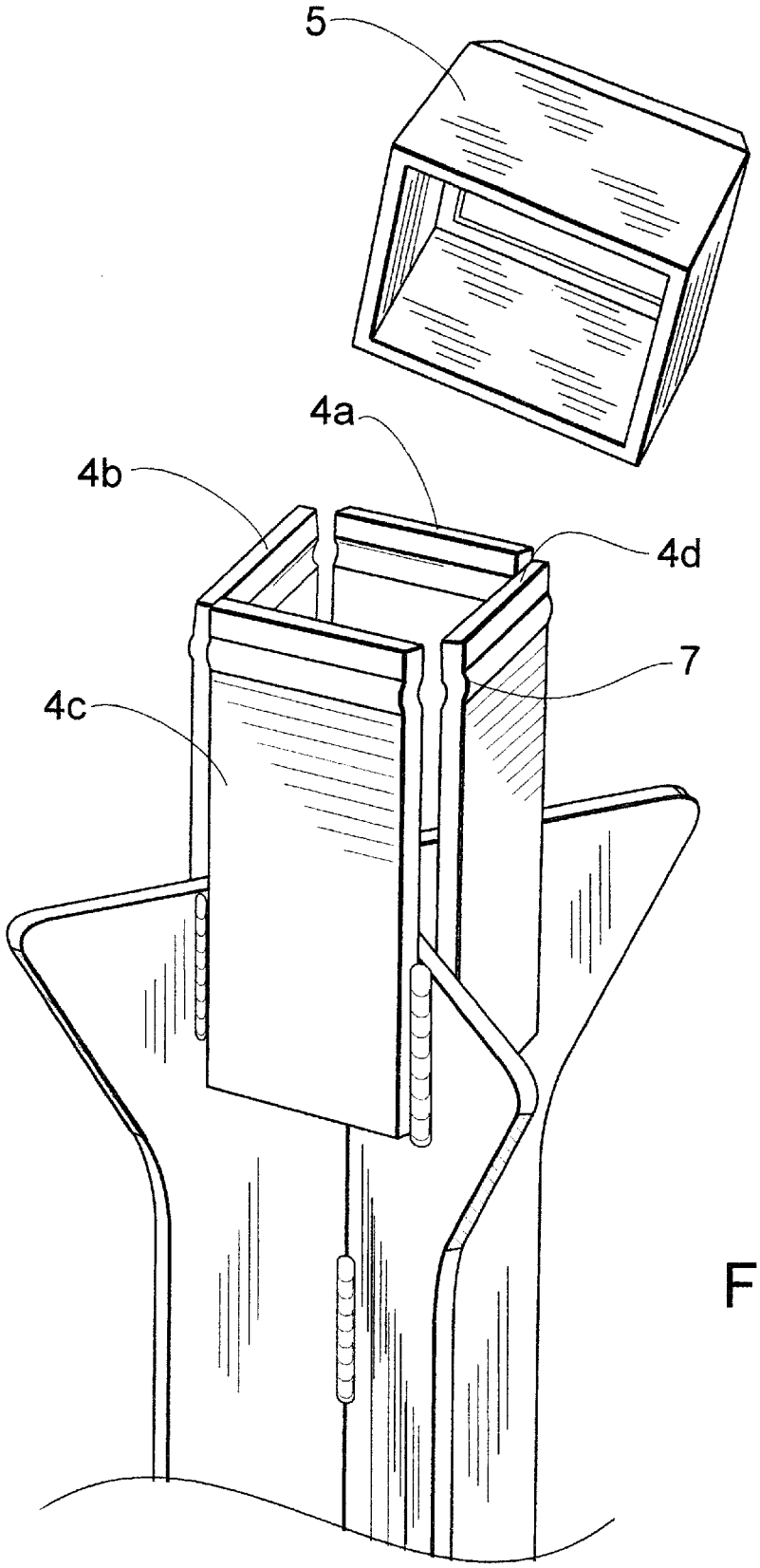
FIG. 8 is an exploded view of a third embodiment of an improved post anchor.

A third embodiment of the post anchor apparatus is shown in FIG. 8. In this embodiment the collets 4*a*–4*d* are each flat and define a space which is a rectangle. The clamping member 5 also has a rectangular cross section and is of a size adapted to engage the ridges 7 in the tops of the collets 4. As with the previous embodiment, a post (not shown) is inserted into the space and the clamping member 5 is forced onto the collets 4 to impact against ridge 7 thereby urging collets 4 to engage the post.

Figure 9:
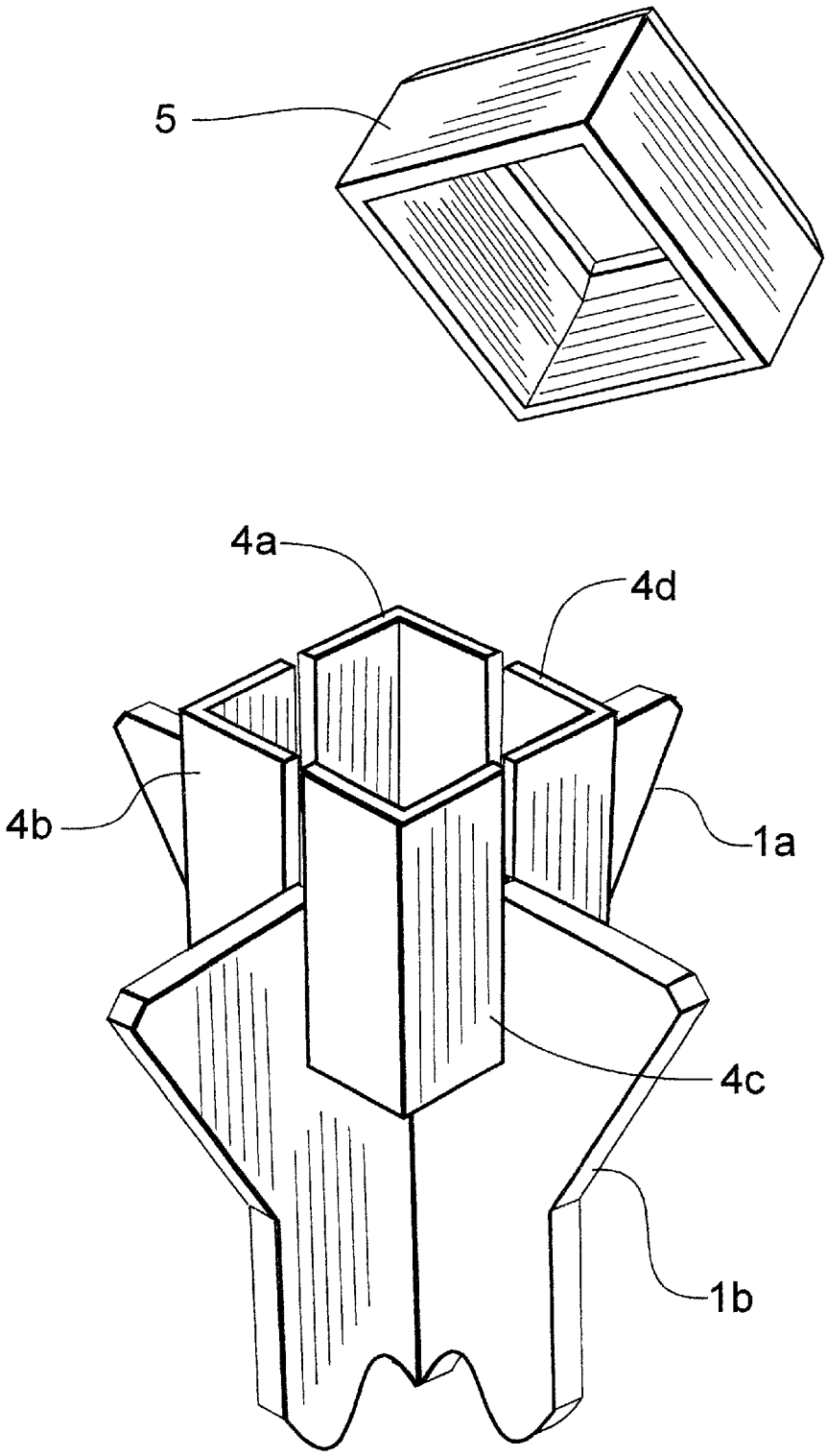
FIG. 9 is an exploded view of a fourth embodiment of an improved post anchor

A fourth embodiment is shown in FIG. 9. In this embodiment the collets 4*a*–4*d* each define a corner of a space to receive a post (not shown). In this embodiment, the collets do not have a ridge, rather the clamping member 5 is tapered so that the clamping member 5 urges the collets 4 against the post as the clamping member is driven into location on the collets.

With the embodiment of FIG. 9 the clamping of the collets to the post can be enhanced (if necessary) by placing packing between the clamping member and the collets. The packing may take the form of nylon bushes, metal wedges or similar material.

The above description has been in terms of a four fin ground engaging portion. The invention is not limited to this situation. In fact, the ground engaging portion may be a single fin or spike although the four fin arrangement is the most suitable in many applications.

It will be appreciated that the improved post anchor described above provides a secure association of the post to the post anchor by virtue of the clamping member urging the collets into clamping engagement with the post. As the clamping member may completely cover the collets, the final appearance is visually pleasing and functionally superior to the prior art. Furthermore, should the post become damaged, it can easily be replaced by removal of the clamping member. Once the clamping member has been removed the pressure on the collets is removed and the post can be easily withdrawn. A new post can then be placed into the space defined by the collets and the clamping member once again forced into position to urge the collets into engagement with the post.

Throughout the specification the aim has been to describe the preferred embodiments of the invention without limiting the invention to any one embodiment or specific collection of features.

What is claimed is:

1. An improved post anchor comprising:

a ground engaging portion comprising two or more fin members;

a post receiving portion comprising two or more collets located between upper portions of said two or more fin members, said collets defining a space dimensioned to receive a post to be associated with said post anchor; and a clamping member which locates around said collets and urges said collets towards engagement with said post when said post is seated in the space, wherein the collets define the cylindrical space and the clamping member is a cup shaped member that seats over the collets; and wherein the cup-shaped clamping member alone causes the engagement without requiring a separate clamping mechanism.

2. The post anchor of claim 1 wherein the ground engaging portion is a stake formed from pressed metal fins that are welded together.

3. The post anchor of claim 1 wherein the space has dimensions slightly larger than corresponding dimensions of the post.

4. The post anchor of claim 1 wherein the clamping member is forced to locate around the collets by applied force.

5. The post anchor of claim 1 wherein the clamping member has an internal thread for screwing onto the collets.

6. The post anchor of claim 1 wherein the clamping member is tapered so to apply increasing pressure to the collets as it is forced into location.

7. The post anchor of claim 1 wherein a ridge is formed towards the top of each collet so that the collet is urged into the space as the clamping member is located around the collets.

8. The post anchor of claim 1 wherein an upper part of the ground engaging portion has a larger diameter to assist with holding the ground engaging portion in the ground.

9. The post anchor of claim 1 further comprising a plurality of deflectable portions formed in the fins.

10. In combination, an improved post anchor comprising:

a ground engaging portion comprising two or more fin members;

a post receiving portion comprising two or more collets located between upper portions of said two or more fin members, said collets defining a space dimensioned to receive a post to be associated with said post anchor;

a clamping member which locates around said collets and urges said collets towards engagement with said post when said post is seated in the space; and a post dimensioned at a lower end to seat within said space, wherein the collets define the cylindrical space and the clamping member is a cup shaped member that seats over the collets; and wherein the cup-shaped clamping member alone causes the engagement without requiring a separate clamping mechanism.

11. An improved post anchor comprising:

a ground engaging portion comprising two or more fin members;

a post receiving portion comprising two or more collets located between upper portions of said two or more fin members, said collets defining a space dimensioned to receive a post to be associated with said post anchor; and a clamping member which locates around said collets and urges said collets towards engagement with said post when said post is seated in the space, wherein a ridge is formed towards the top of each collet so that the collet is urged into the space as the clamping member is located around the collets; and wherein the clamping member is a cup-shaped member that seats over the collets and which alone causes the engagement without requiring a separate clamping mechanism.

12. The post anchor of claim 11 wherein the collets define a rectangular space.

13. The post anchor of claim 12 wherein the collets each define a side of the rectangular space.

14. The post anchor of claim 12 wherein the collets each define a corner of the rectangular space.

* * * * *